United States Patent [19]

French et al.

[11] 4,014,575

[45] Mar. 29, 1977

[54] SYSTEM FOR FUEL AND PRODUCTS OF OIL SHALE RETORT

[75] Inventors: Gordon B. French, Rifle; William J. Bartel; Richard D. Ridley, both of Grand Junction, all of Colo.; Chang Yul Cha, La Verne, Calif.; Robert S. Burton, III, Grand Junction, Colo.

[73] Assignee: Occidental Petroleum Corporation, Los Angeles, Calif.

[22] Filed: July 26, 1974

[21] Appl. No.: 492,599

[52] U.S. Cl. ..... 299/2; 166/256; 166/267

[51] Int. Cl.[2] ..... E21C 41/10; E21B 43/00

[58] Field of Search ..... 299/4, 5, 2; 166/256–262, 302, 303, 272; 208/11; 43/DIG. 6

[56] References Cited

UNITED STATES PATENTS

| | | | |
|---|---|---|---|
| 1,269,747 | 6/1918 | Rogers | 299/2 |
| 1,919,636 | 7/1933 | Karrick | 299/2 |
| 2,481,051 | 9/1949 | Uren | 299/2 |
| 2,801,089 | 7/1957 | Scott, Jr. | 299/2 |
| 3,380,913 | 4/1968 | Henderson | 166/267 X |
| 3,454,958 | 7/1969 | Parker | 166/256 |
| 3,548,938 | 12/1970 | Parker | 166/256 |
| 3,573,194 | 3/1971 | Hopper et al. | 208/11 |

*Primary Examiner*—Ernest R. Purser
*Assistant Examiner*—William F. Pate, III
*Attorney, Agent, or Firm*—Christie, Parker & Hale

[57] ABSTRACT

An underground room in substantially undisturbed shale is filled with fragmented oil shale particles for in situ retorting. A comprehensive system is provided for feeding air to the top of the retort and recovering oil and flue gas from the bottom of the retort. The oil is separated from admixed water and both are recovered. Flue gas is withdrawn from the bottom of the retort, scrubbed clean and a portion may be recycled through the retort while another portion is vented or burned in a turbine. Means are also provided for passing scrubbed gas through a second spent shale retort prior to venting, burning or recycle.

10 Claims, 1 Drawing Figure

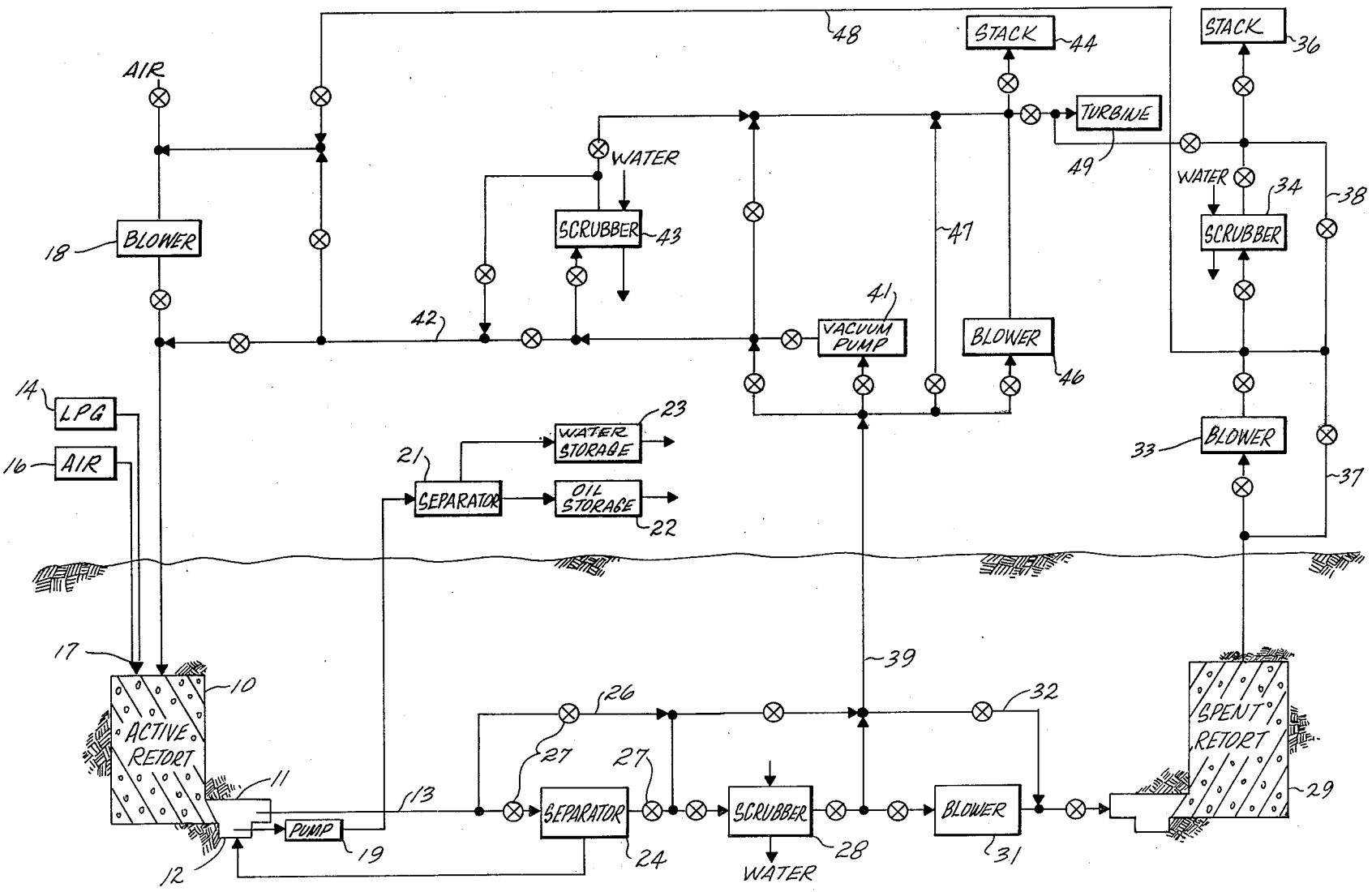
STACK
SCRUBBER
WATER
BLOWER
SPENT RETORT
TURBINE
STACK
BLOWER
VACUUM PUMP
SCRUBBER
WATER
WATER STORAGE
OIL STORAGE
SEPARATOR
BLOWER
SCRUBBER
WATER
SEPARATOR
PUMP
AIR
BLOWER
LPG
AIR
ACTIVE RETORT

SYSTEM FOR FUEL AND PRODUCTS OF OIL SHALE RETORT

BACKGROUND

There are vast deposits of oil shale in the world containing massive reserves of oil that can supplement or replace petroleum supplies. The oil shale contains kerogen which is a solid carbonaceous material from which shale oil can be retorted. Shale oil is retorted by heating the oil shale to a sufficient temperature to decompose kerogen and produce a liquid product which drains from the rock. Small amounts of hydrocarbon gas are also produced. The spent shale after oil has been removed contains substantial amounts of residual carbon which can be burned to supply heat for retorting.

In a particularly desirable process for retorting oil shale a subterranean cavity or room is filled with an expanded mass of oil shale particles and retorting is conducted in situ. The expanded mass of particles and the underground retort are ordinarily formed explosively by any of a variety of known techniques. This retort is ordinarily filled to the top with a mass of oil shale particles known as a rubble pile. The top of this bed of oil shale particles is ignited and air is forced downwardly therethrough for combustion of carbonaceous material in the shale. Initially, some of the shale oil may be burned, but as retorting progresses, much of the combustion is of residual carbon remaining in the spent shale. This reduces the oxygen content of the air and the resultant gas passing downwardly through the retort below the combustion zone is essentially inert. This inert gas transfers heat downwardly and results in retorting of the shale below the combustion zone without appreciable combustion of the resulting oil. The flue gas at the bottom of the retort is largely nitrogen, with carbon dioxide, carbon monoxide, water vapor, hydrogen, methane, and traces of other hydrocarbon gases. The flue gas has appreciable amounts of water and oil in the form of aerosol dispersions. It may also contain sulphur dioxide from the combustion processes.

Often it is desirable to recirculate a portion of the flue gas through the retort with the incoming air to enhance the heating value of the flue gas or to increase the yield of oil by burning combustible material in the flue gas in lieu of retorted shale oil. Cleaning of the flue gas prior to recirculation or venting to the atmosphere is desirable. Further, if the flue gas is employed in a gas turbine or the like to provide power, it is desirable to preliminarily clean the flue gas prior to combustion to minimize turbine corrosion.

The system for operating the retort and recovering products operates for long periods of time, since the combustion zone travels rather slowly through the retort. It is, therefore, desirable to have a reliable and flexible system that operates economically for long periods of time.

BRIEF SUMMARY OF THE INVENTION

There is, therefore, provided in practice of this invention according to a presently preferred embodiment, a system for operating an oil shale retort and recovering the oil and flue gas therefrom. In such a system, the underground oil shale retort has a blower for providing air to the top and means for withdrawing flue gas from the bottom. Separators and scrubbers remove aerosols and water soluble materials from the flue gas. A portion of the scrubbed gas may be recycled through the retort with the inlet air, and other portions may be vented or burned in a turbine to produce power. Flue gas withdrawn from the retort may be passed through a second underground retort containing a bed of spent shale and this gas may also be recycled, vented or burned for producing power. An oil-water mixture from the bottom of the retort is separated into its salable oil and reusable water.

DRAWING

These and other features and advantages of the present invention will be appreciated as the same becomes better understood by reference to the following detailed description of a presently preferred embodiment when considered in connection with the accompanying drawing which is a schematic flow diagram for an oil shale retorting system constructed according to principles of this invention.

DESCRIPTION

The drawing illustrates in block diagram form a comprehensive system for handling the feed and products of an in situ oil shale retort. As illustrated in this presently preferred embodiment, there is an underground active retort 10 which is in the form of a subterranean room filled with oil shale particles. The room and bed of particles are preferably created simultaneously by explosives. The room is surrounded by substantially undisturbed shale which is relatively impervious so that substantial amounts of fluids do not leak in or out of the active retort. At the bottom of the retort there is a lateral tunnel 11 containing a sump 12 in the floor in which liquids from the retort can collect. The tunnel is closed beyond the sump by any suitable bulkhead, and a flue gas line 13 is in fluid communication with the bottom of the retort.

The active retort is ignited by liquified petroleum gas 14 and compressed air 16 fed down to a burner 17 at the top of the retort. Access to the top of the retort is provided by a bore hole (not shown) through the undisturbed shale, and the burner is temporarily lowered down the hole and operated until a sufficient volume of shale has been heated above its self-ignition temperature. The burner can then be withdrawn and the retort operated in its normal retorting mode.

In the illustrated arrangement, the retort is indicated to be a substantial distance below the ground surface, and the bore hole may extend from the surface down to the top of the retort. Many elements of the system such as the LPG and air supplies are located at the ground surface. It will be apparent that if desired, access to the top of the retort can be from a tunnel above the retort, and some of the system elements may be located underground or at the ground surface at the end of the tunnel. Generally speaking, substantial volumes of gas are being handled, and it is desirable to keep the gas flow distances short to minimize line pressure drops and friction losses.

Compressed air is supplied to the top of the retort by a blower 18; a conventional Roots type blower may advantageously be used for this purpose. The air from the blower passes to the top of the retort by way of the bore hole through the undisturbed shale from the surface to the top of the retort. The volume of air blown through the retort is in the order of 0.5 to 2.5 SCFM per square foot of cross-sectional area of the retort.

High pressures are not required, since the pressure drop through the retort is ordinarily in the order of only a few psi.

The air flowing down through the retort from the blower 18 supports combustion in the oil shale in a conventional manner, so that oil is retorted from the shale. Oil flows from the bottom of the retort into the sump 12. Water may also accumulate in the sump from a variety of sources including water deliberately added to the retort, water leaking into the retort from subterranean aquifers, or condensed products of combustion and decompositon of water-bearing minerals. The oil-water mixture is removed from the sump by a pump 19 which typically is controlled by a float in the sump since, at times, continuous operation of the pump may not be required. The pump 19 is, along with other equipment hereinafter mentioned, preferably located in a tunnel near the bottom of the retort.

The oil-water mixture is pumped to the ground surface where it goes to a separator 21. The separator can provide a simple gravity separation of oil and water, however, it is found that strong emulsions of oil in water and water in oil ordinarily are encountered. Conventional means for breaking this emulsion may also be included in the separator to improve the efficiency of separation. Oil so separated is conveyed to an oil storage reservoir 22 from which it is conveyed to pipeline, trucking, refinery, or like facilities for usage. The water from the separator is conveyed to a water storage pond 23. This water is "sour water" containing soluble materials from the oil and retort and should not be imposed on the environment without purification. It is, however, water that is useful in continued operation of the retorting system and may be recirculated for cooling, scrubbing and other water usage purposes.

Flue gas from the bottom of the retort is first passed through a conventional separator 24 for removal of entrained water and oil which are returned to the sump 12. A bypass 26 is provided around the separator and is controlled by valves 27. This permits temporary bypassing of the separator for maintenance, cleaning or the like.

Throughout the drawing, numerous valves for control of the fluids in the system are illustrated. The same symbol is used for these valves as for the valves 27 and in general, these will not be specifically mentioned in the description, since their uses are readily apparent to one skilled in the art. These valves may be automatically controlled in some cases so as to be responsive to pressure, temperature, flow rate or the like, or may be manually operated. Such control is conventional and in general is not set forth in greater detail hereinafter.

Flue gas from the separator then passes through a conventional Venturi scrubber 28 which also serves to reduce the content of aerosols and some water soluble materials in the flue gas. Preferably both the separator and Venturi scrubber are located in the tunnel near the bottom of the retort so that preliminary cleaning of the flue gas occurs promptly and removed material may be returned to the sump.

In one mode of operation it may be desirable to pass the flue gas through a second spent retort 29. This second retort is one in which oil shale has been previously retorted to decompose the kerogen. It, too, is a subterranean room filled with a bed of fragmented oil shale particles. This retort has been previously operated in the same general manner as the active retort so that the shale particles are "spent" and are in the form of a solid "ash" which may have substantial quantities of unburned carbon distributed therein. In general, the spent retort can be considered identical to the active retort except for the fact that it is filled with spent shale. The temperature in the spent retort can range anywhere from ambient temperatures up to several hundred degrees Fahrenheit. There are a variety of reasons for running the flue gas through the spent retort, including enhancement of the fuel value by enrichment from remaining carbonaceous material in the spent retort, removal of sulphur dioxide and other contaminants including aerosols by contact with the substantial surface area of spent shale, and the like.

Preferably, the flue gas is passed through the spent retort from the bottom to the top to minimize the distance that the flue gas must travel between retorts. A blower 31 in the tunnel adjacent the bottoms of the two retorts 10 and 29 withdraws gas from the active retort and causes it to flow through the spent retort. This blower provides the principal force for the pressure drop in the spent retort. A bypass 32 is provided around the blower, since under some conditions, natural convection in the spent retort and withdrawal of gas from the top can effect a substantial flow of flue gas through the spent retort without the blower. Such operation is ordinarily practiced only temporarily during maintenance of the blower.

Flue gas from the top of the spent retort 29 is withdrawn by a gas blower 33 ordinarily located at the ground surface. Flue gas from this blower is passed through a final water scrubber 34 for removal of any remaining aerosol, water soluble materials, or dust that may be present in the flue gas. The flue gas may then be passed to a vent stack 36 and vented to the atmosphere, preferably with flaring of the gas to consume combustible materials and reduce odorous products, if any. It might be noted that additional combustible gas may be added to the flared flue gas to assure a sufficient flame temperature. A bypass 37 is provided around the gas blower 33 so that if the gas pressure from the underground blower 31 is sufficient, gas may flow from the spent shale retort without further assistance. Likewise, the final flue gas scrubber has a bypass 38 to permit bypassing during operation wherein substantially all noxious materials are removed by the Venturi scrubber 28 and spent retort 29. Temporary bypassing is also available in case of needed maintenance of the final flue gas scrubber 34.

Gas from the bottom of the active retort after aerosol separation and preliminary scrubbing may be withdrawal by a line 39 extending from the tunnel to the ground surface. A vacuum pump 41 is connected to this line so that a less than atmospheric pressure may be maintained at the bottom of the active retort if desired. The vacuum pump outlet is connected by a recycle line 42 to the air inlet to the top of the active retort 10. This recycle of flue gas from the vacuum pump can be either upstream or downstream from the inlet air blower 18 depending on the relative pressures prevailing in the system. A water scrubber 43 is also connected to the outlet of the vacuum pump so that if desired recycled gas can be further scrubbed prior to being put back into the top of the active retort. The scrubber 43 is particularly useful if, as indicated in the drawing, a portion of the flue gas is conducted to a vent stack 44 for flaring or venting to the atmosphere. A blower 46 is also connected to the flue gas line 39 so that in the alternative flue gas can be diverted directly to the vent stack if the vacuum pump is not operating. A bypass 47 is also provided to the stack to provide venting of the bottom of the retort in a situation where both the vacuum pump and blower are not operating.

It will also be noted that after passing through the spent retort, flue gas can be recycled from the blower 33 to the air inlet by a line 48. This permits an alternative mode of operation wherein flue gas modified by passage through the spent retort is recycled instead of flue gas directly from the active retort.

Flue gas from either the scrubber 34 connected to the spent retort, or the scrubber 33 connected to the outlet of the active retort can be conducted to a conventional gas turbine 49 for production of power. When the heating value of the flue gas is sufficiently high, it can be burned in a turbine or other power generating device so that electric power can be generated for operating various equipment at the retorting site. Substantial amounts of energy can be contained in this flue gas which is advantageously employed for generating power rather than simply flaring or venting to the atmosphere. It is preferred that the flue gas to the turbine be water scrubbed prior to use so that sulphur bearing materials are substantially completely removed for inhibition of corrosion of the turbine.

Although limited embodiments of system for operating an in situ oil shale retort and recovering the products thereof have been described and illustrated herein, many modifications and variations will be apparent to one skilled in the art. It will also be apparent that in a system of this complexity many temperature, pressure, flow rate and other measurements will be made. The details of such measurements and their use in control of the system will be apparent to those skilled in the art. It is, therefore, to be understood that within the scope of the appended claims, the invention may be practiced otherwise than as specifically described.

What is claimed is:

1. An in situ oil shale retorting system comprising:

an active underground retort comprising a room in substantially undisturbed shale containing a bed of fragmented oil shale particles with a sufficient void volume distributed therethrough to permit gas flow;

an air blower having an air inlet and an outlet connected to the top of the active retort for forcing air downwardly therethrough and sustaining a combustion zone in the retort;

a sump at the bottom of the active retort for collecting oil and water from the retort;

separator means connected to the sump for separating oil and water;

means for withdrawing flue gas from the bottom of the active retort;

separator means connected to the means for withdrawing flue gas from the retort for separating entrained oil or water from the flue gas;

means connected to the means for withdrawing flue gas for selectively mixing flue gas with the inlet air for recycling a portion of the flue gas through the retort;

gas scrubber means connected to the means for withdrawing for reducing content of aerosols in the flue gas; and a vent stack connected to the gas scrubber means for venting a portion of the flue gas.

2. An in situ oil shale retorting system as defined in claim 1 wherein the gas scrubber means comprises a Venturi scrubber and the means for withdrawing flue gas comprises a flue gas blower, both being located in a tunnel adjacent the bottom of the active retort and further comprising:

a spent underground retort comprising a room in substantially undisturbed shale containing a bed of fragmented spent oil shale particles with a sufficient void volume distributed therethrough to permit gas flow, having its bottom connected to the flue gas blower outlet and its top selectively connected to the means for recycling and the vent stack.

3. An in situ oil shale retorting system as defined in claim 1 wherein the means for withdrawing flue gas comprises a vacuum pump connected to the bottom of the active retort and the gas scrubber means is between the bottom of the retort and the vacuum pump and further comprising an additional gas scrubber between the outlet of the vacuum pump and the vent stack.

4. An in situ oil shale retorting system as defined in claim 1 further comprising a gas turbine connected to the outlet of the means for withdrawing gas for generating power by burning flue gas.

5. An in situ oil shale retorting system comprising:

an active underground retort comprising a room in substantially undisturbed shale containing a bed of fragmented oil shale particles with a sufficient void volume distributed therethrough to permit gas flow;

an air blower having an air inlet and an outlet connected to the top of the active retort for forcing air downwardly therethrough and sustaining a combustion zone in the retort;

a sump at the bottom of the active retort for collecting oil and water from the retort;

separator means connected to the sump for separating oil and water;

a spent underground retort comprising a room in substantially undisturbed shale containing a bed of fragmented spent oil shale particles with a sufficient void volume distributed therethrough to permit gas flow;

means for conveying flue gas from the bottom of the active retort to the bottom of the spent retort for forcing flue gas upwardly therethrough; and means for selectively recycling a portion of the flue gas from the top of the spent retort to the top of the active retort.

6. An in situ oil shale retorting system as defined in claim 5 wherein the means for conveying comprises means for reducing the content of entrained oil and water in the flue gas between the active retort and the spent retort and returning the separated oil and water to the sump.

7. An in situ oil shale retorting system as defined in claim 6 further comprising:

a vacuum pump connected to the means for separating entrained oil and water for selectively withdrawing flue gas from the bottom of the active retort;

means connected to the outlet of the vacuum pump for selectively recycling a portion of the flue gas from the active retort for mixing with the inlet air to the top of the active retort; and a vent stack connected to the outlet of the vacuum pump for selectively venting glue gas therefrom to the atmosphere.

8. An in situ oil retorting system as defined in claim 5 further comprising:

a water scrubber connected to the top of the spent retort for reducing the content of aerosols and water soluble materials in the flue gas; and a vent stack connected to the water scrubber for venting at least a portion of the flue gas to the atmosphere.

9. An in situ oil shale retorting system as defined in claim 5 further comprising:

a water scrubber connected to the top of the spent retort for reducing the content of aerosols and water soluble materials in the flue gas; and a turbine connected to the water scrubber for generating power by burning a portion of the flue gas.

10. An in situ oil shale retorting system comprising:

an active underground retort comprising a room in substantially undisturbed scale containing a bed of fragmented oil shale particles with a sufficient void volume distributed therethrough to permit gas flow;

an air blower having an air inlet and an outlet connected to the top of the active retort for forcing air downwardly therethrough and sustaining a combustion zone in the retort;

a sump at the bottom of the active retort for collecting oil and water from the retort;

a sump pump adjacent the sump for extracting oil and water therefrom;

liquid separator means connected to the sump pump for separating oil and water;

flue gas separator means at an outlet from the bottom of the active retort for separating entrained oil or water from flue gas from the bottom of the retort and returning separated oil and water to the sump;

a Venturi scrubber connected to the flue gas separator means for reducing entrained aerosols in the flue gas;

a vacuum pump connected to the Venturi scrubber for withdrawing gas from the bottom of the retort through the flue gas separator means and Venturi scrubber;

means connected to the outlet of the vacuum pump for selectively mixing flue gas with inlet air to the active retort for recycling a portion of the flue gas to the top of the retort;

a water scrubber connected to the outlet of the vacuum pump for further reducing the content of aerosols and water soluble materials in the flue gas;

a spent underground retort comprising a room in substantially undisturbed shale containing a bed of fragmented spent oil shale particles with a sufficient void volume distributed therethrough to permit gas flow;

a flue gas blower connected to the Venturi scrubber and the bottom of the spent retort for selectively cycling a portion of the flue gas from the bottom of the active retort to the bottom of the spent retort;

a water scrubber connected to the top of the spent retort for further reducing the content of aerosols and water soluble materials in the flue gas therefrom; and a vent stack connected to each of the water scrubbers for selectively venting a portion of the flue gas to the temperature.

* * * * *

UNITED STATES PATENT AND TRADEMARK OFFICE

CERTIFICATE OF CORRECTION

PATENT NO. : 4,014,575

DATED : March 29, 1977

INVENTOR(S) : Gordon B. French, William J. Bartel, Richard D. Ridley, Chang Yul Cha, Robert S. Burton, III It is certified that error appears in the above-identified patent and that said Letters Patent are hereby corrected as shown below:

Column 6, line 67, "glue" should be -- flue --.

Column 7, line 18, "scale" should be -- shale --.

Column 8, line 32, "temperature" should be -- atmosphere --.

Signed and Sealed this

Fourteenth Day of June 1977

[SEAL]

*Attest:*

RUTH C. MASON
*Attesting Officer*

C. MARSHALL DANN
*Commissioner of Patents and Trademarks*